United States Patent [19]

Tsuneda

[11] Patent Number: 4,951,574

[45] Date of Patent: Aug. 28, 1990

[54] CONVEYOR SYSTEM USING AUTOMOTIVE CART

[75] Inventor: Masayuki Tsuneda, Komaki, Japan

[73] Assignee: Daifuku Co., Ltd., Japan

[21] Appl. No.: 375,188

[22] Filed: Jul. 3, 1989

Related U.S. Application Data

[63] Continuation-in-part of Ser. No. 200,712, May 31, 1988, abandoned.

[51] Int. Cl.[5] ..... B61L 15/00

[52] U.S. Cl. ..... 104/295; 104/288; 246/122 R; 246/187 R; 191/33 R

[58] Field of Search ..... 191/33 R, 22 R, 34, 191/23 R; 246/122 R, 187 R, 182 B, 182 R; 104/288, 295, 301, 300, 249, 250, 284, 167, 290, 291, 292

[56] References Cited

U.S. PATENT DOCUMENTS

| | | | |
|---|---|---|---|
| 3,085,646 | 4/1963 | Paufve | 246/187 B |
| 3,284,614 | 11/1966 | Bramer | 246/122 B |
| 3,408,646 | 10/1968 | Simon et al. | 246/187 B |
| 4,480,157 | 10/1984 | Ishikura et al. | 191/34 |
| 4,570,543 | 2/1986 | Ishikura et al. | 104/300 |
| 4,700,024 | 10/1987 | Hasselmann et al. | 246/122 R |
| 4,811,667 | 3/1989 | Morishita et al. | 104/249 |

FOREIGN PATENT DOCUMENTS

| | | | |
|---|---|---|---|
| 2640247 | 3/1978 | Fed. Rep. of Germany | 246/187 B |
| 0125959 | 6/1986 | Japan . | |
| 1081474 | 8/1967 | United Kingdom | 246/187 B |
| 1362142 | 7/1974 | United Kingdom | 246/187 B |

*Primary Examiner*—Robert P. Olszewski
*Assistant Examiner*—Mark T. Le
*Attorney, Agent, or Firm*—Barnes, Kisselle, Raisch, Choate, Whittemore & Hulbert

[57] ABSTRACT

A conveyor system comprises a conveyor rail and an automotive cart which travels along the conveyor rail. The automotive cart obtains power for travel from power supply rails installed in the conveyor rail. The automotive cart has a first signal receiving member for stop signal and a first signal transmitting member for automotive cart signal. The rail has a second signal transmitting member for the stop signal and a second signal receiving member for the automotive cart signal located at suitable positions on the rail. The automotive cart transmits and receives control signals for its travel by means of their signal transmitting members and signal receiving members. The first signal receiving member on the automotive cart is a magnetic sensor, while the second signal transmitting member comprises an electromagnet. The electromagnet includes magnetic pole plates having along the conveyor rail a length which is almost the same as or longer than the brake distance of the automotive cart.

3 Claims, 5 Drawing Sheets

CONVEYOR SYSTEM USING AUTOMOTIVE CART

This is a continuation-in-part of co-pending application Ser. No. 07,200,712, filed on May 31, 1988 now abandoned.

FIELD OF THE INVENTION

The present invention relates to a conveyor system using an automotive cart utilized for conveying loads in a space or factory.

BACKGROUND OF THE INVENTION

This type of conveyor system has been proposed which, as in Japaneses Patent Application Laid-Open Specification No. 61-125959, comprises two power supply rails and one signal rail which are laid in a conveyor rail for supporting and guiding an automotive cart, two current collectors adapted for slide contact with said power supply rails, and a single brush adapted for slide contact with said signal rail. Electric power is fed through the current collectors to the automotive cart, and transfer of various control signals is made through the brush between the signal rail and the automotive cart.

However, the conventional system described above is disadvantageous in that installing a signal rail over the entire length of the conveyor path is expensive. Further since the brush involves slide contact, it becomes necessary to replace it when worn out, and the brush entails formation of dust particles. Further, since the conveyor rail of the automotive cart consists of a number of rail members connected together into a continuous form, the "sectioning" of the conveyor rail required for the function of the signal rail is complicated.

SUMMARY OF THE INVENTION

An object of the invention is to provide a conveyor system using an automotive cart which allows transfer of control signals without involving slide contact and which makes it possible to section the conveyor rail as desired.

A conveyor system which achieves this object comprises:

a conveyor rail for supporting and guiding an automotive cart and a pair of power supply rails installed in the conveyor rail, the automotive cart having current collectors adapted for slide contact with the power supply rails for supplying power to the automotive cart, magnetic sensor means for receiving a stop signal, and means for transmitting an automotive cart signal, the conveyor rail having electromagnet means for transmitting the stop signal to the magnetic sensor means on the automotive cart, and means for receiving the automotive cart signal, the electromagnet means being installed at stop positions of the automotive cart, the electromagnet means including coil means and magnetic pole plates attached to the coil means, the magnetic pole plates having along said conveyor rail a length which is almost the same as or longer than the distance the automotive cart moves to stop after receiving said stop signal.

According to the arrangement of the invention described above, as the current collectors are in slide contact with the power supply rails, the automotive cart, guided by the conveyor rail, travels along a given path determined by the conveyor rail. During travel, the automotive cart automatically stops as the receiving means on the automotive cart receives a stop signal from the transmitting means on the conveyor rail. The automotive cart could stop within the location where electromagnet means is installed on the conveyor rail, since the magnetic pole plates have a length along the conveyor rail the same as or longer than the brake distance of the cart. Consequently, the cart can maintain its stopped state receiving the stop signal continuously from the electromagnet means, and a device to maintain the stopped state of the automotive cart is not required and further the cart could start again for traveling in forward or rearward direction from that stopped position by means of eliminating the stop signal. As receiving means on the conveyor rail receives an automotive cart signal from the transmitting means on the automotive cart, the position where the automotive cart is in, that is, the presence of the automotive cart in a section along the conveyor path or in a station are recognized.

Therefore, control signals can be transferred without resorting to slide contact, eliminating the need of laying expensive signal rails over the entire length of the conveyor rail and, moreover, formation of dust particles can be prevented. Further, since the parts associated with the conveyor rail have only to be attached to necessary locations, the sectioning of the conveyor rail can be made as desired.

DESCRIPTION OF THE EMBODIMENTS

Figure 1:
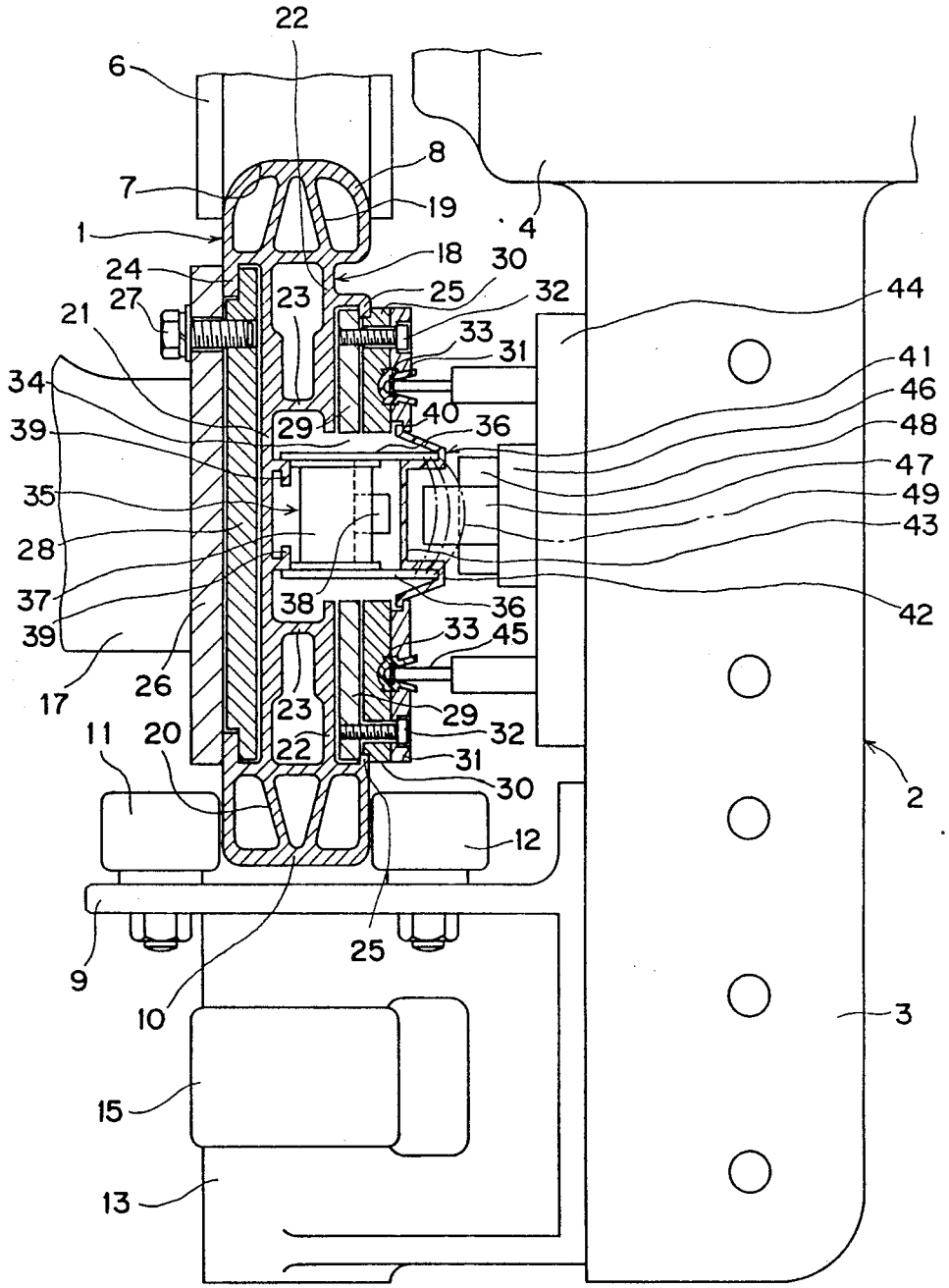
FIG. 1 is a front view, in section, of the principal portion of a conveyor system using an automotive cart according to the invention.
Figure 2:
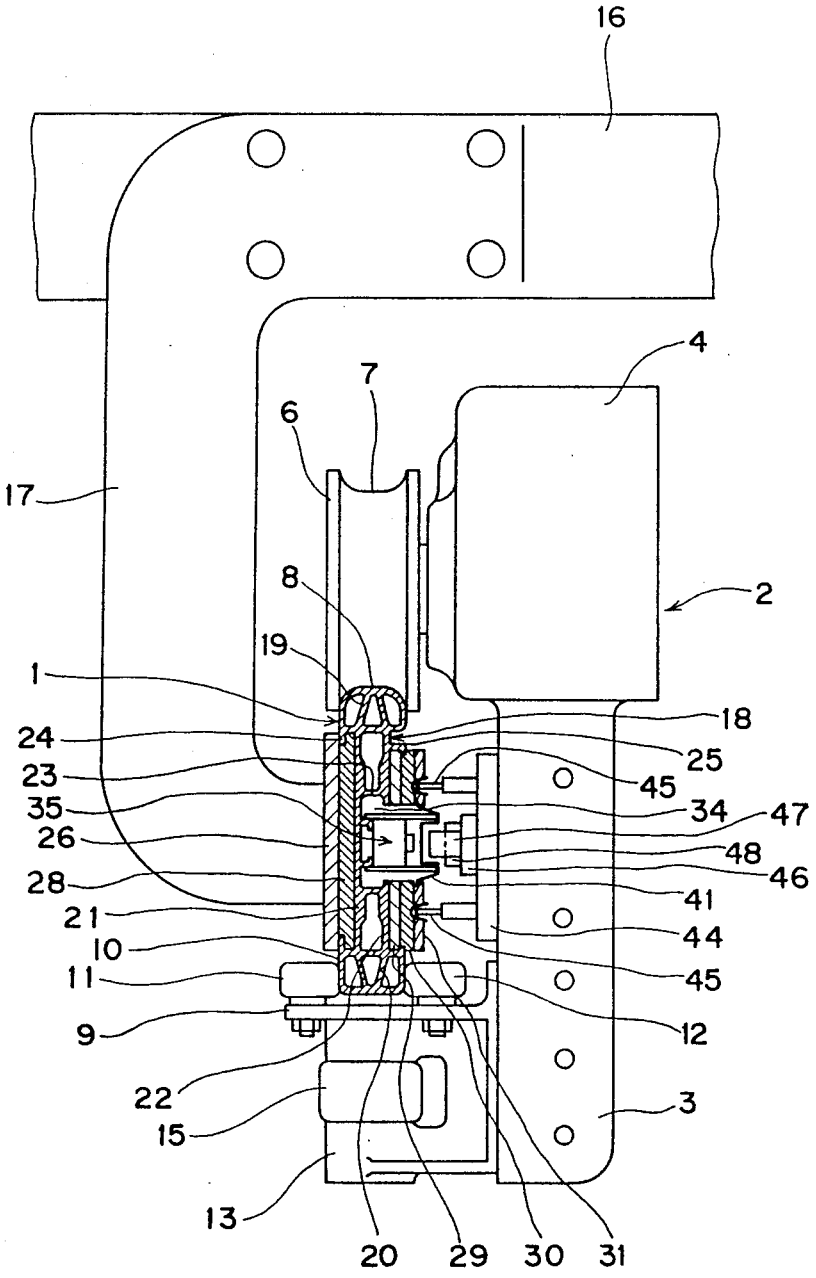
FIG. 2 is a front view of the conveyor system shown in FIG. 1.
Figure 3:
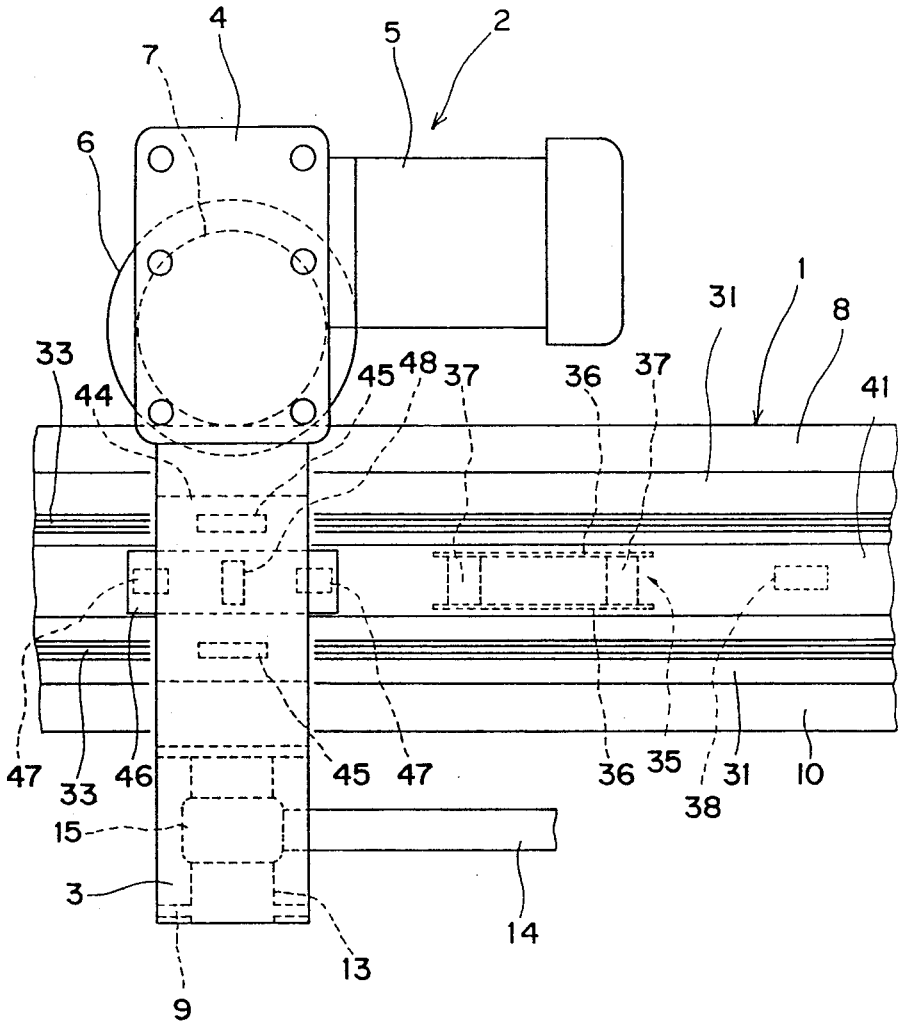
FIG. 3 is a side view of the conveyor system shown in FIG. 2.

In FIGS. 1 through 3, the numeral 1 denotes a conveyor rail of vertically elongated cross section for an automotive cart 2 to travel therealong.

The automotive cart 2 has a vertically extending frame 3 positioned on one side of the conveyor rail 1 and is provided at the upper end thereof with a gear case 4. Attached to the gear case 4 are a motor 5 and a drive wheel 6 driven through reduction gears (not shown) in the gear case 4. The drive wheel 6 has a groove 7 on its outer periphery adapted to fit on the head 8 of the conveyor rail 1. The lower portion of the frame 3 is attached thereto a bracket 9 projecting at a level below the conveyor rail 1. The bracket 9 is attached thereto a pair of sway-preventive rollers 11 and 12 adapted to hold the bottom 10 of the conveyor rail 1 therebetween from opposite sides. The sway-preventive rollers are provided at two locations (not shown), two rollers each, lengthwise of the conveyor rail 1; thus, four rollers hold the bottom 10 of the conveyor rail 1, so that the automotive cart 2 is prevented from swaying.

The bracket 9 is provided with a holder 13 for suppoorting one end 15 of a connecting rod 14. The connecting rod 14 is used to connect the automotive cart 2 to a free cart (not shown) movably supported, for example, by the conveyor rail 1. The automotive cart 2, the free cart and the connecting rod 14 constitute a conveyor cart, and a load can be conveyed along the coveyor rail 1 as by suspending said load from the connecting rod 14.

The conveyor rail 1 is attached to ceiling beam 16 and is supported at a predetermined level in the air by brackets 17 arranged at suitable interval lengthwise of the conveyor rail 1. More particularly, the conveyor rail 1 has said head 8, bottom 10 and a connecting wall 18 which connects them together, said head 8, bottom 10 and connecting wall 18 being of hollow construction. The head 8 and bottom 10 are internally formed with reinforcing partition walls 19 and 20, respectively. The connecting wall 18 is formed of a pair of lateral walls 21 and 22 and a pair of upper and lower partition walls 23 which connect said lateral walls 21 and 22 together.

The upper and lower opposite lateral sides of the connecting wall 18 are formed with engaging projections 24 and 25 projecting toward each other lengthwise of the conveyor rail 1. Each bracket 17 is provided at its front end with an attaching plate 26 to which a fixing plate 28 is fixed by a bolt 27 to clamp the engaging projections 24 between the attaching plate 26 and the fixing plate 28, whereby the conveyor rail 1 is fixed to the bracket 17.

The side of the connecting wall 18 opposite the bracket 17 is constructed as follows: Pairs of upper and lower base plates 29 and upper and lower inner and outer support plates 30 and 31 are clamped together by bolts 32 with the engaging projections 25 being clamped between the base plates 29 and the inner support plates 30, whereby the base plates 29 and the inner and outer support plates 30 and 31 are fixed to the conveyor rail 1. A pair of upper and lower power supply rails 33 are clamped between the inner and outer support plates 30 and 31 and thereby fixed in position.

The side of the conveyor rail 1 opposite the bracket 17 is formed with a recess 34 extending from the outer surface of the support plates 31 to the inner surface of the lateral wall 21 and arranged over the length of the conveyor rail 1. Installed in the recess 34 are electromagnets 35. Each electromagnet 35 comprises a pair of upper and lower magnetic pole plates 36 and a pair of coils 37 spaced from each other lengthwise of the conveyor rail 1. The magnetic pole plates 36 engage projections 39 integrally formed on the inner surface of the lateral plate 21, whereby the electromagnet 35 is positioned. The peripheral edges of the recess 34 in the outer support plates 31 are formed with engaging projections 40 through which an insulating cover 41 for closing the recess 34 and covering the electromagnet 35 is removably installed. This insulating cover 41 has, at the position of the electromagnet 35, convex portions 42 for covering the front ends of the magnetic pole plates 36, and a concave portion 43 formed between the magnetic pole plates 36.

The frame 3 of the automotive cart 2 has an attaching plate 44 fixed thereto, and a pair of current collectors 45 adapted for slide contact with the power supply rails 33 are attached to said attaching plate 44. A holder plate 46 is attached to the surface of the attaching plate 44 between the current collectors 45. The opposite ends of the holder plate 46 as viewed lengthwise of the conveyor rail 1 are provided with a pair of magnetic sensors 47. The intermediate portion of the holder plate 46 as viewed lengthwise of the conveyor rail 1 is provided with a permanent magnet 48. Each magnetic sensor 47 is capable of detecting a magnetic flux 49 formed between the magnetic pole plates 36.

Figure 5:
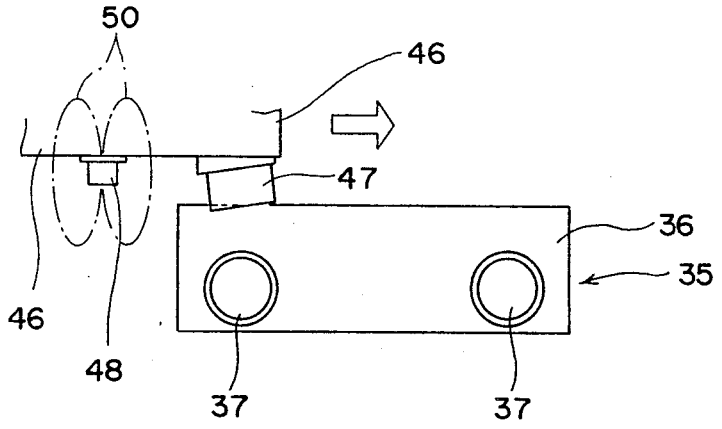
FIG. 5 is a diagrammatic plan view showing a first operating state of the conveyor system according to the invention.
Figure 6:
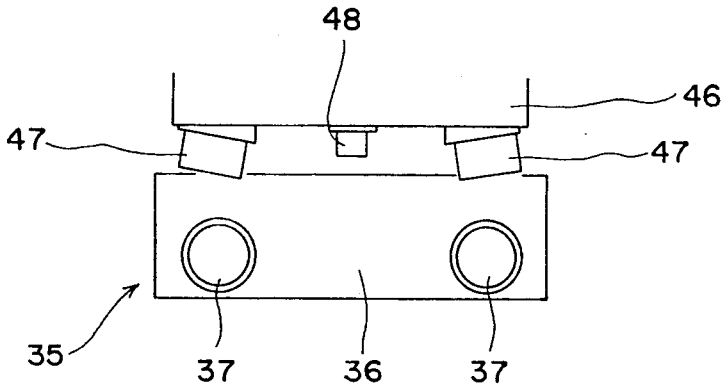
FIG. 6 is a diagrammatic plan view showing a second operating state of the conveyor system according to the invention.

A magnetic sensor 38 is disposed in the recess 34 at a distance from the electromagnet 35 in the lengthwise direction of the conveyor rail 1 not to be affected by the magnetism of the electromagnet 35. The magnetic sensor 38 can detect a magnetic flux 50 formed by a permanent magnet of the automotive cart 2 (FIG. 5).

Figure 4:
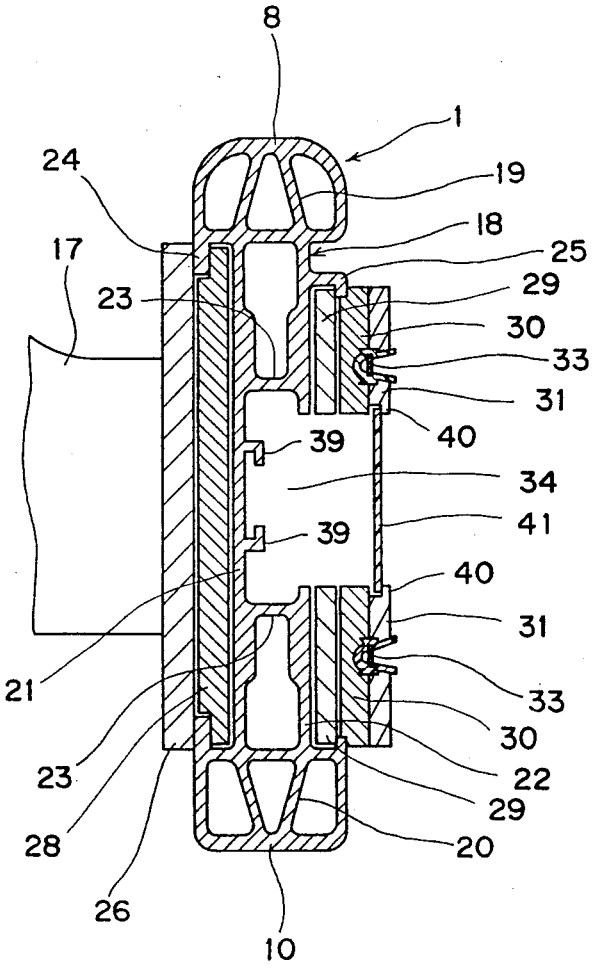
FIG. 4 is a cross sectional view of a conveyor rail with no parts mounted thereon.

FIG. 4 shows the cross-sectional construction around the conveyor rail 1 at a position where there are no electromagnet 35 and magnetic sensor 38 formed therein.

The automotive cart 2 travels as it is supported and guided by the conveyor rail 1 by the motor 5 driving the drive wheel 7 through the reduction gears in the gear case 4. At this time, the sway-preventive rollers 11 and 12 hold the bottom 10 of the conveyor rail 1, thereby preventing the automotive cart 2 from swaying when it is traveling.

During this travel, when the coils 37 are not energized, there is no magnetic flux formed between the magnetic pole plates 36; thus, the magnetic sensors 47 passing by the coils 47 disposed between the magnetic pole plates 36 receive no stop signal based on said magnetic flux. On the other hand, a magnetic flux 50, that is, automotive cart signal, formed by the permanent magnet 48 mounted on the automotive cart 2 is detected by the magnetic sensor 38, whereby the fact the automotive cart 2 passes by the location where this magnetic sensor 38 is installed, that is, the fact that automotive cart is present in a certain section is detected. The detection signal is sent to a control device (not shown).

To stop a specified automotive cart 2 at a specified station, coils 37 corresponding to the specified station are energized before said automotive cart arrives. Thus, as shown in FIG. 1, the magnetic flux 49 serving as a stop signal is formed between the front ends of the magnetic pole plates 36. Therefore, as shown in FIG. 5, one of the magnetic sensors 47 coming in together with the automotive cart 2 detects the magnetic flux 49 at the position of one of the coils 37, thereby stopping the motor 5 and applying brakes. Thus, the automotive cart 2 stops after running some brake distance.

The magnetic pole plates 36 have a length along the conveyor rail 1. The length is almost the same as or longer than the brake distance of the automotive cart 2. As a result, the automotive cart 2 stop within the location where electromagnet 35 is disposed and maintain its stopped state while the magnetic sensors 47 continuously detect the magnetic flux 49. When the magnetic flux 49 is extinguished by cutting off the current supply to the coils 37, the magnetic sensors 47 detect the magnetic flux no longer and the automotive cart 2 can start again for traveling in forward or rearward direction.

When the automotive cart 2 passes the magnetic sensor 38 of the conveyor rail 1, the magnetic sensor 38 detects the magnetic flux 50 formed by the permanet magnet 48. As a result, the position where the automotive cart 2 is in, that is, the presence of the automotive cart 2 in a section along the conveyor path or in a station are recognized.

The rail-associated device 35 can be cleaned, inspected, replaced or displaced by removing the insulating cover 41.

In the above embodiment, magnetic sensors 47 have been attached to the front and rear of the automotive cart 2; however, only one may be installed. In addition, the provision of two ensures that the rear one will satisfactorily act in the case of overrun and makes it possible for the automotive cart 2 to travel in both forward and rearward directions satisfactorily.

In the above embodiment, the automotive cart 2 has been shown by way of example as one adapted to run along a monorail type conveyor rail 1; however, it may be a four-wheeled cart.

What is claimed is:

1. A conveyor system using an automotive cart, comprising:

a conveyor rail for supporting and guiding an automotive cart and a pair of power supply rails installed in said conveyor rail, said automotive cart having current collectors adapted for slide contact with said power supply rials of supplying power to the atuomotive cart, magnetic sensor means for receiving a stop signal, and means for transmitting an automotive cart signal.

said conveyor rail having electromagnet means for transmitting said stop signal to the magnetic sensor means on said automotive cart, and means for receiving said automotive cart signal, said electromagnet means being installed at stop positions of said automotive cart, said electromagnet means including coil means and magnetic pole plates attached to said coil means, said magnetic pole plates having along said conveyor rail a length which is almost the same as or longer than the distance said automotive cart moves to stop after receiving said stop signal.

2. A conveyor system as set forth in claim 1, wherein the magnetic sensor means on the automotive cart are provided on the front and rear of the automotive cart.

3. A conveyor system as set forth in claim 1, wherein the signal transmitting means on the automotive cart is permanent magnet means, while the signal receiving means on the conveyor rail is magnetic sensor means.

* * * * *